US012751513B2

(12) United States Patent
Cutts

(10) Patent No.: US 12,751,513 B2
(45) Date of Patent: Oct. 6, 2026

(54) TRI-LAYERED HEAD COVERING MULTIPURPOSE HEAD GARMENT FOR HAIR AND CLOTH PROTECTION (TAI SIMPLY)

(71) Applicant: Sandra Cutts, Madison, AL (US)

(72) Inventor: Sandra Cutts, Madison, AL (US)

( * ) Notice: Subject to any disclaimer, the term of this patent is extended or adjusted under 35 U.S.C. 154(b) by 155 days.

(21) Appl. No.: 17/566,380

(22) Filed: Dec. 30, 2021

(65) Prior Publication Data

US 2025/0143396 A1 May 8, 2025

Related U.S. Application Data

(60) Provisional application No. 63/205,720, filed on Jan. 5, 2021.

(51) Int. Cl.

| | |
|---|---|
| ***A42B 1/017*** | (2021.01) |
| ***A42B 1/004*** | (2021.01) |
| ***A42B 1/019*** | (2021.01) |
| ***A42B 1/041*** | (2021.01) |

(52) U.S. Cl.
CPC ..... *A42B 1/017* (2021.01); *A42B 1/004* (2013.01); *A42B 1/019* (2021.01); *A42B 1/041* (2013.01)

(58) Field of Classification Search
CPC ..... A42B 1/041
See application file for complete search history.

(56) References Cited

U.S. PATENT DOCUMENTS

| | | | | |
|---|---|---|---|---|
| 2002/0104150 | A1* | 8/2002 | Hill | A42B 1/041 2/174 |
| 2016/0198830 | A1* | 7/2016 | Tussey | A42B 1/049 2/183 |
| 2018/0235411 | A1* | 8/2018 | Guerra-Sievers | A42B 1/041 |
| 2019/0045902 | A1* | 2/2019 | Baker | A42C 5/00 |

* cited by examiner

*Primary Examiner* — Grady Alexander Nunnery
(74) *Attorney, Agent, or Firm* — Leonard Searcy, II

(57) ABSTRACT

A head accessory, aka head covering, headscarf, head garment or head wrap, that protects the hair, cloth and allows one to be fashionable during the day and at bedtime. This innovative inner insulator type fabric, 3-layered all-in-one multifunctional light weight structured technique style for a head covering product does not exist. The uniqueness of the head covering products' middle/inner liner repellent/insulator type fabric, dual functionality/purpose is novel. The inner structure piece is made of a thin, light, durable type material that minimize the penetration of hair liquid. The fashionable decorative head covering, head wrap, headscarf, head garment can protect the hair along with minimizing the penetration of hair liquid onto ones' linen. Moreover, the fashionable day and evening wear covering can protect, keep hair hydrated and moisten while one engages in daily activities.

5 Claims, 1 Drawing Sheet

TRI-LAYERED HEAD COVERING MULTIPURPOSE HEAD GARMENT FOR HAIR AND CLOTH PROTECTION (TAI SIMPLY)

CROSS-REFERENCE TO RELATED APPLICATIONS

None.

BACKGROUND

Other head coverings, while not of the 3-layered all-in-one multifunctional light weight structure as a healthy hair maintainer and surface protection type that the Applicant here proposes, are found in U.S. Pat. Nos. 7,634,819; 7,096,510; 6,799,581; 6,567,991; 3,889,298; and U.S. Publication 2006/0162046.

SUMMARY

A tri-layered head covering product (garment) that protects the hair, ones' linen or clothing and is fashionable, able to wear day or night.

BRIEF DESCRIPTION OF FIGURES

Non-limiting and non-exhaustive examples are described with reference to the following figures.

Figure 1:
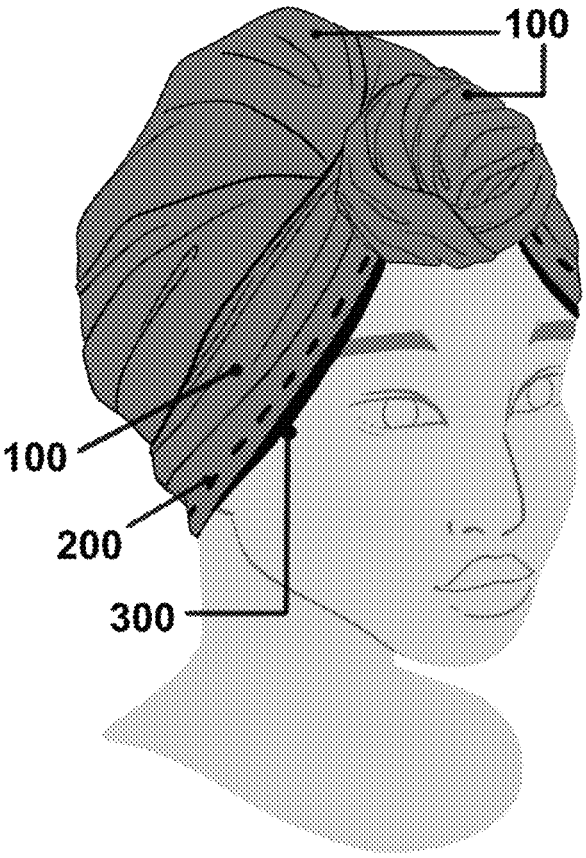
FIG. 1 is a perspective view of the all-in-one 3-layered technique of the head covering/wrap.
Figure 2:
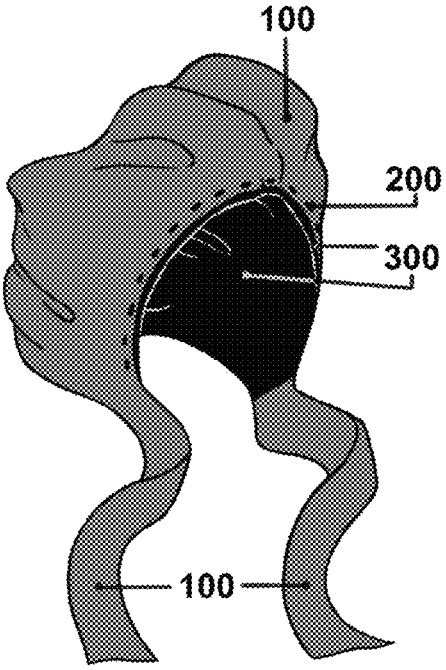
FIG. 2 is an unwrapped view illustration of an example of the wearable head wrap.

The short broken lines in FIGS. 1 and 2 illustrate the middle repellent/insulator lining (FIG. 1, 200) that is sawn between the embroidery decorative outer layer fiber (FIG. 1, 100) and inside head covering layer that contacts the hair (FIG. 1, 300) is designated by the thick solid black line, of which, the inside fabric contacts and protects the hair.

DETAILED DESCRIPTION

Descriptive Overview: Innovative Process for Head Covering Accessory

Tri-layered all-in-one protective fashionable head covering. The multipurpose functionality for the tri-layer head covering garment (product) serves to protect the hair and cloth and is stylish, able to be worn to bed, outdoors, and around the home. Specifically, the unique inner structured innovative technique offers a head covering product that protects the hair and linen along with stylishness, all-in-one garment.

As indicated in FIG. 1 (FIG. 1) on page 3 of the following drawings, the present innovative technique invention is a 3-layered, all-in-one multifunctional head covering.

The head covering, head wrap, headscarf can be worn during the day as well as while sleeping.

Specifically, layer 3 (see FIG. 1, label 300) which is the inside part of the head covering that contacts the hair, is made of lining that is a light weight durable protective soft type fiber/fabric that protects the hair and maintain healthy moisture.

Moreover, the middle/inner layer (see FIG. 1, label 200) is of an insulator light weight lining type material that minimizes the penetration of ones' hair liquid.

Lastly, the outer layer (see FIG. 1, label 100) of the innovative tri-layered head covering Product is made of decorative fashionable material having the ends length that facilitates wrapping to prevent head wrap from sliding off the head.

The tri-layered head covering allows one to wear this head garment at work, events, outdoors, around the home, or in bed and be stylish.

This light weight multifunctional all-in-one head covering product technique does not exist and would be ideal for today's renaissance and multitasking individuals.

The invention claimed is:

1. A tri-layered head covering comprising:

three layers that are worn as a style and provide hair and surface protection, and further comprises:

a first layer that is configured to contact the hair on a head, wherein the first layer is made of a durable, soft, and light weight protective fabric;

a second layer that overlays and touches the first layer, wherein the second layer is made of a light, thin, repellent, insulating fabric; and a third layer that overlays and touches the second layer and functions as an outer layer, wherein the third layer is made of a decorative, fashionable material and has ends of length that facilitate wrapping to prevent the tri-layered head covering from falling off the head, wherein the durable, soft, and light weight protective fabric is an inner fabric that is configured to contact hair, wherein the durable, soft, and light weight protective fabric is configured to provide protection to the hair and to maintain moisture in the hair.

2. The tri-layered head covering of claim 1, wherein the durable, soft, and light weight protective fabric is an inner fabric that is configured to contact hair.

3. The tri-layered head covering of claim 1, wherein the light, thin, repellent, insulating fabric is a second fabric that functions as a padding that is configured to minimize a penetration of liquid from the hair.

4. The tri-layered head covering of claim 1, wherein the decorative, fashionable material includes a third fabric that has ends that are configured to facilitate wrapping to prevent the tri-layered head covering from sliding off the head.

5. The tri-layered head covering of claim 1, further comprising the three layers are permanently attached to each other and are durable, decorative, and fashionable.

* * * * *